US011230023B2

(12) United States Patent
Petratou et al.

(10) Patent No.: US 11,230,023 B2
(45) Date of Patent: Jan. 25, 2022

(54) RAZOR HANDLE

(71) Applicant: Bic Violex S.A., Anixi (GR)

(72) Inventors: Maria Petratou, Athens (GR); Ioannis Marios Psimadas, Athens (GR); Efthymios Saltas, Athens (GR)

(73) Assignee: Bic Violex S.A., Anoixi (GR)

( * ) Notice: Subject to any disclaimer, the term of this patent is extended or adjusted under 35 U.S.C. 154(b) by 143 days.

(21) Appl. No.: 16/610,754

(22) PCT Filed: May 4, 2018

(86) PCT No.: PCT/EP2018/061494
§ 371 (c)(1),
(2) Date: Nov. 4, 2019

(87) PCT Pub. No.: WO2018/202847
PCT Pub. Date: Nov. 8, 2018

(65) Prior Publication Data

US 2020/0070376 A1 Mar. 5, 2020

(30) Foreign Application Priority Data

May 5, 2017 (EP) ..... 17169735

(51) Int. Cl.
*B26B 21/52* (2006.01)
*B26B 21/22* (2006.01)

(52) U.S. Cl.
CPC ..... *B26B 21/521* (2013.01); *B26B 21/225* (2013.01)

(58) Field of Classification Search
CPC ..... B26B 21/521; B26B 21/52; B26B 21/522; B26B 21/225; B26B 21/528;
(Continued)

(56) References Cited

U.S. PATENT DOCUMENTS 3,388,831 A 6/1968 Hansom
4,392,303 A 7/1983 Ciaffone
(Continued)

FOREIGN PATENT DOCUMENTS

CN 101612740 A 12/2009
CN 201645522 U 11/2010
(Continued)

OTHER PUBLICATIONS

International Search Report and Written Opinion issued in related International Application No. PCT/EP2018/061494 dated Aug. 13, 2018 (10 pages).
(Continued)

*Primary Examiner* — Ghassem Alie
(74) *Attorney, Agent, or Firm* — Bookoff McAndrews, PLLC

(57) ABSTRACT

A razor handle and an exchangeable razor blade cartridge and method for releasing the exchangeable razor blade cartridge from the razor handle. The razor handle includes an elongated body, a connector, and a release mechanism. The connector is configured to connect an exchangeable razor blade cartridge to the razor handle and the release mechanism is configured to release the exchangeable razor blade cartridge from the razor handle. The razor handle further includes a release trigger, offset from the connector in a longitudinal direction of the elongated body, and a transmission mechanism connecting the release trigger to the release mechanism.

20 Claims, 6 Drawing Sheets

(58) Field of Classification Search
CPC ..... B26B 21/4093; B26B 21/227; B26B 21/4037; B26B 21/40
USPC ... 30/532, 527, 85, 47, 89, 40.1, 50, 87, 86, 30/338, 528, 832, 53, 3, 51, 60, 529, 30/34.2, 531; 15/104.94, 145, 146, 171, 15/176.1, 177, 172
See application file for complete search history.

(56) References Cited

U.S. PATENT DOCUMENTS

| | | | | |
|---|---|---|---|---|
| 4,446,619 | A * | 5/1984 | Jacobson | B26B 21/521 30/47 |
| 4,658,505 | A | 4/1987 | Williams | |
| 4,993,154 | A | 2/1991 | Radcliffe | |
| 2007/0214662 | A1* | 9/2007 | Efthimiadis | B26B 21/521 30/527 |
| 2015/0283716 | A1 | 10/2015 | Kim | |
| 2017/0136638 | A1 | 5/2017 | Hage et al. | |
| 2018/0141225 | A1* | 5/2018 | Zucker | B26B 21/443 |

FOREIGN PATENT DOCUMENTS

| | | | |
|---|---|---|---|
| CN | 103317534 | A | 9/2013 |
| CN | 104582913 | A | 4/2015 |
| JP | 4848110 | B2 | 12/2011 |
| WO | WO8304386 | W | 12/1983 |
| WO | WO2010078564 | A3 | 7/2010 |
| WO | WO2017174120 | A1 | 10/2017 |

OTHER PUBLICATIONS

Office Action issued in Chinese Patent Application No. 201880025332.1, dated Dec. 25, 2020 (12 pages).
Search Report issued in Chinese Patent Application No. 201880025332.1, dated Dec. 14, 2020 (2 pages).
Extended European Search Report in European Patent Application No. 17169735, dated Nov. 2, 2017 (6 pages).

* cited by examiner

RAZOR HANDLE

CROSS REFERENCE TO RELATED APPLICATIONS

This application is a National Stage application of International Application No. PCT/EP2018/061494, filed on May 4, 2018, now published as WO/2018/202847 and which claims priority to European Application No. 17169735.2, filed May 5, 2017.

FIELD

The present disclosure relates to razors, and more specifically to razors of the type comprising a razor handle and an exchangeable razor blade cartridge. The razors may be specifically adapted for shaving facial, head and/or body hair, and may further allow for replacement of the exchangeable razor blade cartridge, in particular when a razor blade or blades of the razor blade cartridge have been blunted, without discarding the razor handle.

BACKGROUND

Razors comprising a razor handle and an exchangeable razor blade cartridge are commonly known in the art. In such razors, the razor handle may comprise an elongated body extending in a longitudinal direction from a front end to a rear end, a connector for connecting an exchangeable razor blade cartridge to the razor handle, a release mechanism for releasing the exchangeable razor blade cartridge from the razor handle, and a release trigger, located at the front end of the razor handle, in close proximity to the release mechanism and connector, to trigger the release of the exchangeable razor blade cartridge from the connector.

A drawback of this configuration is that, because the release trigger is located near the front end of the razor handle, release of the exchangeable razor cartridge may be inadvertently triggered by a user moving his grip closer to the front end of the razor handle when trying to achieve a more precise shave.

SUMMARY

A first aspect of the disclosure concerns providing a more convenient and safer razor handle and in particular a razor handle having an elongated body, a connector for connecting an exchangeable razor blade cartridge to the razor handle, a release mechanism for releasing the exchangeable razor blade cartridge from the razor handle, and a release trigger, wherein the risk of inadvertent release of an exchangeable razor blade cartridge may be decreased.

Accordingly, in at least one aspect, the release trigger may be movable in a transverse direction of the elongated body and offset from the connector in a longitudinal direction of the elongated body, and the razor handle further comprise a transmission mechanism connecting the release trigger to the release mechanism and comprising a mechanism for converting a motion of the release trigger in the transverse direction into a motion in the longitudinal direction.

Consequently, a user moving his grip on the razor handle closer to the razor blades will not inadvertently trigger the release of the exchangeable razor blade cartridge. Longitudinally offset from the connector, the release trigger should not interfere with the user gripping the razor handle. In this respect, to prevent interference of the release trigger with the user gripping the razor handle, when the elongated body extends in the longitudinal direction between a front and a rear end, the release trigger may, in particular, be located in a middle segment of the elongated body, between the front and rear ends.

The transmission mechanism may be spring-loaded such that a predetermined force may be imposed in response to the user actuating the release trigger. The predetermined spring-load force may also serve to automatically return the transmission mechanism and release trigger towards an initial position after actuation. Additionally, the release trigger may also be spring-loaded itself to counter internal friction at the transmission mechanism. Alternatively or complementarily to spring forces, however, magnetic forces may be used as return forces.

For ease of operation, the release trigger may be formed as a push button. According to a particular aspect, the mechanism for converting a motion of the release trigger in the transverse direction into a motion in the longitudinal direction may be a cam mechanism. However, alternatives to a cam mechanism may also be considered for this same purpose, such as, for instance, a crank mechanism.

To provide a reliable transmission from the release trigger to the release mechanism, the transmission mechanism may in particular comprise a pushrod for transmitting a motion along the longitudinal axis from the release trigger to the connector to actuate the release mechanism.

When the transmission mechanism comprises a cam mechanism and a pushrod, the cam mechanism may comprise a cam surface connected to the release trigger and a cam follower connected to the pushrod and engaging the cam surface. One of the cam surface and the cam follower may include an inclined surface. The other one of the cam surface and the cam follower may include a rounded surface which may engage the inclined surface.

The razor handle may be simply and reliably connected to the exchangeable razor blade cartridge by a snap-fit connection in which a latching surface of the exchangeable blade cartridge engages an opposite surface of the connector to retain the exchangeable razor blade cartridge relative to the connector. The release mechanism may be configured to deflect the latching surface of the exchangeable blade cartridge out of engagement with the connector thereby releasing the snap-fit connection. However, alternatives to such a snap-fit connection may be considered, such as, for instance, a magnetic connection or a press-fit connection.

The razor handle may further comprise a spring-loaded pusher for urging a pivotable head of the exchangeable razor blade cartridge in one pivoting direction. The spring-loaded pusher may also provide for closer contact and better alignment of the razor blades with the skin during shaving. Aspects may further comprise forming the release mechanism as a fork-shaped ejector comprising two front prongs, and positioning the spring-loaded pusher between the two front prongs. This structure allows for a more compact arrangement.

A second aspect of the disclosure relates to a razor comprising a razor handle and an exchangeable razor blade cartridge connected by the connector to the razor handle.

The exchangeable razor blade cartridge may comprise an interconnecting member configured to engage the connector and a pivotable head. The interconnecting member facilitates engagement of the exchangeable razor blade cartridge with the connector. The pivotable head may comprise at least one razor blade and may be supported so as to pivot around at least one transverse axis with respect to the interconnecting member. The exchangeable razor blade cartridge and pivotable head may provide for a closer contact and better alignment of the razor blades with the skin during shaving. The exchangeable razor blade cartridge may be snap-fitted to the connector. The snap-fit connection may ensure a reliable and simple connection of the razor handle to the exchangeable razor blade cartridge. However, as noted above, alternatives to such a snap-fit connection may be considered, such as, for instance, a magnetic connection or a press-fit connection.

Further aspects relate to a method for releasing an exchangeable razor blade cartridge from a razor handle. The method may comprise a step of actuating a release trigger. The method may further comprise another step of transmitting a motion from the release trigger to actuate a release mechanism, which may release the exchangeable razor blade from a connector. This connector may be offset from the release trigger in a longitudinal direction of an elongated body of the razor handle.

The above summary is not intended to describe each embodiment or every implementation of the concept. In particular, selected features of any illustrative embodiment within this disclosure may be incorporated into additional embodiments unless clearly stated to the contrary.

BRIEF DESCRIPTION OF THE DRAWINGS

The disclosure may be more completely understood in consideration of the following detailed description of aspects of the disclosure in connection with the accompanying drawings, in which.

Figure 1:
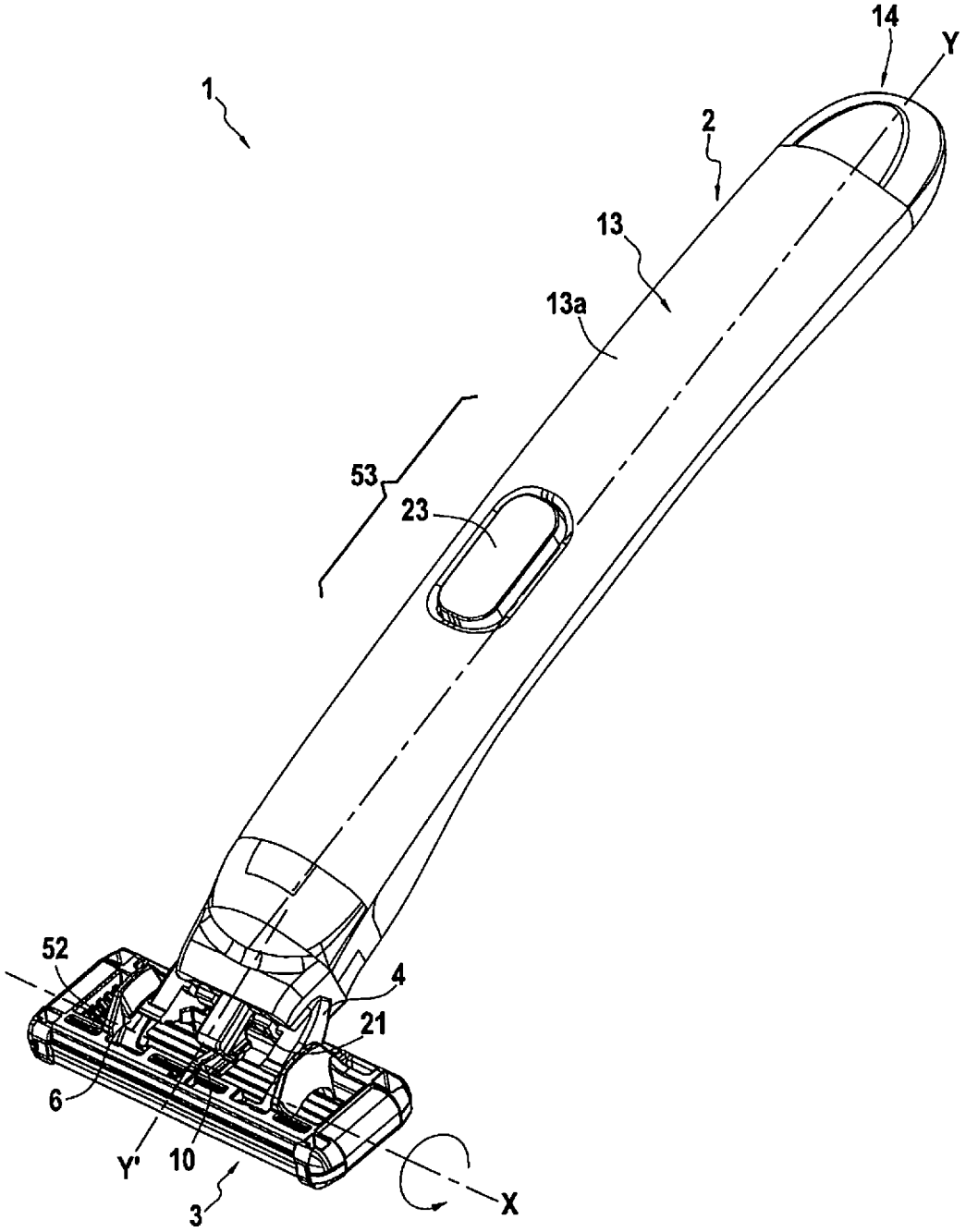
FIG. 1 is a first perspective view of a razor according to a first example.

While aspects of the disclosure are amenable to various modifications and alternative forms, specifics thereof have been shown by way of example in the drawings and will be described in detail. It should be understood, however, that the intention is not to limit aspects of the disclosure to the particular examples described. On the contrary, the intention is to cover all modifications, equivalents, and alternatives falling within the scope of the disclosure.

DETAILED DESCRIPTION

As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

The following detailed description should be read with reference to the drawings. The detailed description and the drawings, which are not necessarily to scale, depict illustrative aspects of the disclosure and are not intended to limit the scope of the disclosure. The illustrative aspects of the disclosure depicted are intended only as exemplary.

Figure 2:
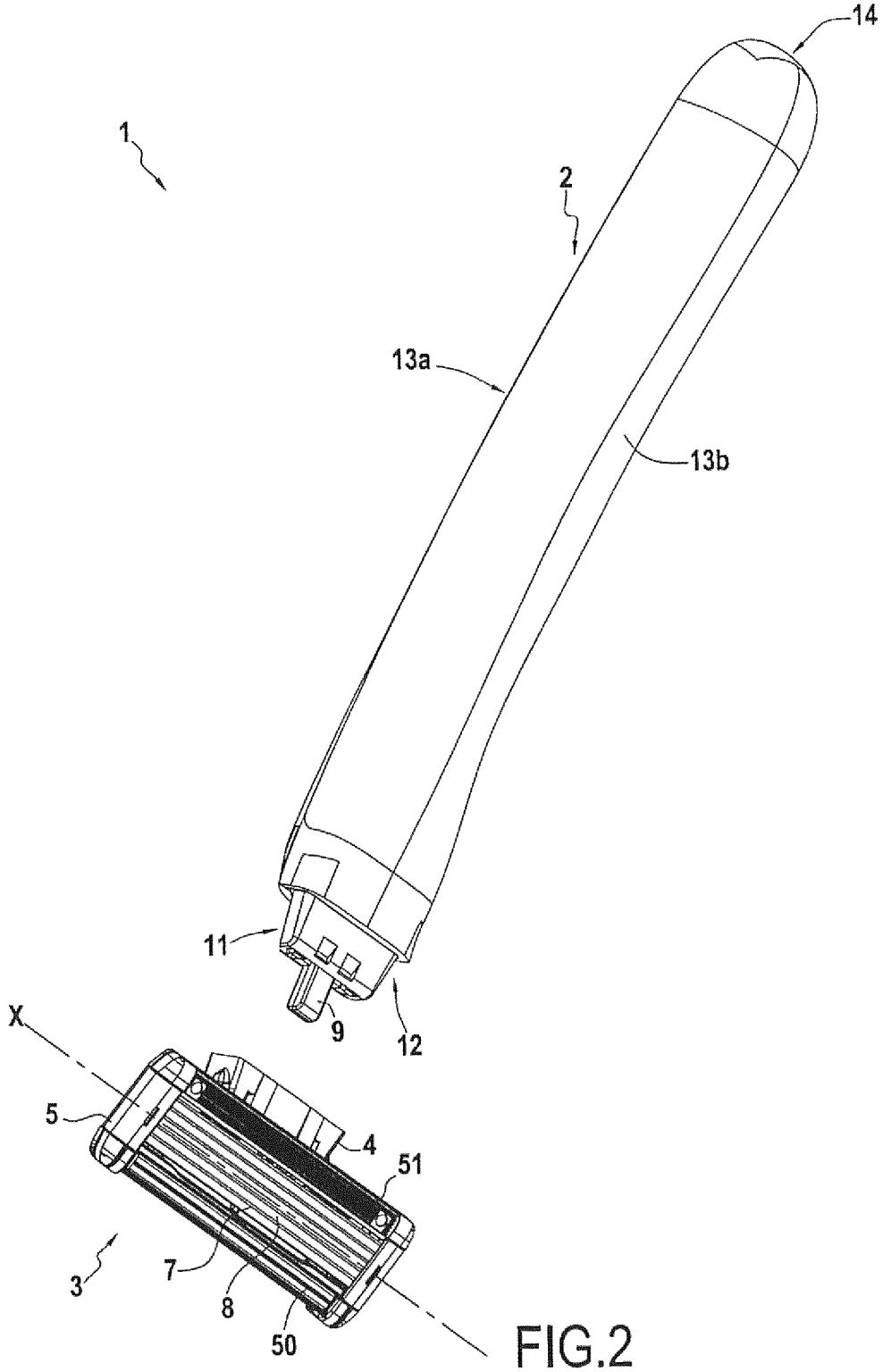
FIG. 2 is a second perspective view of the razor of FIG. 1, wherein the exchangeable razor blade cartridge has been released from the razor handle.
Figure 3:
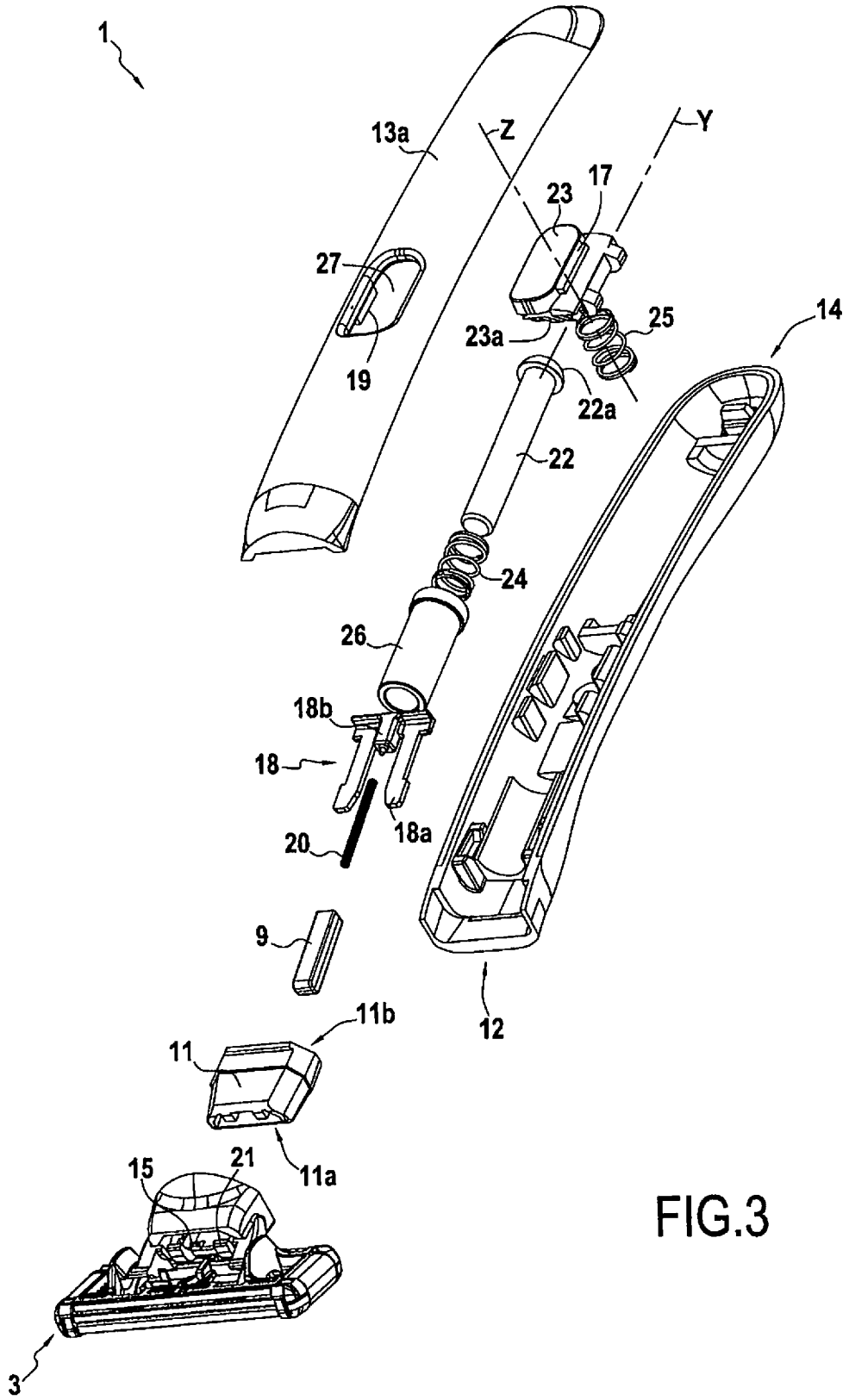
FIG. 3 is a perspective exploded view of the same razor.

A razor 1 according to an aspect is shown in FIGS. 1 to 3. The razor 1 may be a wet-shave razor. The razor 1 may comprise a razor handle 2 and an exchangeable razor blade cartridge 3. The exchangeable razor blade cartridge 3 may comprise an interconnecting member 4 and a pivotable head 5 connected to the interconnecting member 4. The interconnecting member 4 may include arcuate tracks 6 configured to support razor blades 8. The pivotable head 5 may be a multi-blade head, for example a five-blade head. Alternatively, however, it may comprise one single razor blade. The pivotable head 5 may be supported by arcuate tracks 6 of the interconnecting member 4 so as to be pivotable, relative to the interconnecting member 4, about at least one transverse axis X which is substantially parallel to the cutting edges 7 of razor blades 8 mounted on the pivotable head 5.

Further aspects may comprise a connector 11 disposed at a front end 12 of the razor handle 2. The razor handle 2 may comprise a spring-loaded pusher 9. The spring-loaded pusher 9 may protrude from the front end 12 of the razor handle 2 and through the interconnecting member 4 to push against a contact surface 10 of the pivotable head 5. The spring-loaded pusher 9 may push against the contact surface 10 along a pushing axis Y', orthogonal and offset with respect to the transverse axis X, so as to urge the pivotable head 5 in a pivoting direction about transverse axis X thereby maintaining close contact and optimal alignment of the razor blades with respect to the skin during shaving. Although in the illustrated razor 1 the pivotable head 5 is pivotable only around one axis, according to further aspects it may be pivotable around more than one axis. The pivotable head 5 may further comprise, a lubricant strip 50 and/or a finned guard bar 51 disposed adjacent to the cutting edges 7 of the razor blades 8. The lubricant strip 50 and/or finned guard bar 51 may be configured to further improve the shaving feel. According to further aspects, the razor blades 8 may be resiliently supported on the pivotable head 5 by being mounted for example on blade springs 52 for a closer shave. Alternatively, however, the razor blades 8 could be directly fixed onto the pivotable head 5, without any such blade springs.

Figure 7A:
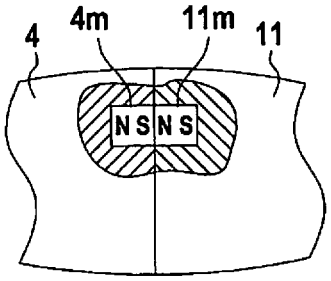
FIGS. 7A and 7B schematically illustrates alternative magnetic and press-fit connections.

The razor handle 2 may comprise an elongated body 13 extending along longitudinal axis Y from the front end 12 to a rear end 14. As shown in FIG. 3, the elongated body 13 may comprise two half-shells 13*a*, 13*b*, joined in a longitudinal plane. The interconnecting member 4 of exchangeable razor blade cartridge 3 may be snap-fitted onto connector 11 of the razor handle 2. According to further aspects, the interconnecting member 4 may comprise protruding lips 15. As shown on FIGS. 4 and 5, the protruding lips 15 may be configured to snap into corresponding undercuts 16 of connector, when connector 11 is inserted into the interconnecting member 4. Following the snap-fit connection, latching surfaces 15*a* on the protruding lips 15 of the interconnecting member 4 engage opposite surfaces 16*a* of the undercuts 16 of connector 11 to prevent separation of exchangeable razor blade cartridge 3 from razor handle 2. Although in FIGS. 4 and 5 the connection is thus shown as a snap-fit connection, alternatives may instead be considered, such as, for instance, a magnetic connection or a press-fit connection. FIG. 7A schematically illustrates a magnetic connection which may comprise magnets 4*m* and

Figure 7B:
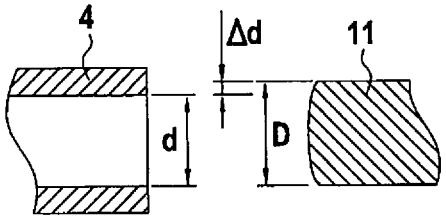

11*m* on, respectively, interconnecting member 4 and connector 11. The magnets 4*m* and 11*m* may be oriented with opposite-sign poles facing each other so as to attract the interconnecting member 4 to the connector 11. FIG. 7B schematically illustrates a press-fit connection which may have an interference Ad between a dimension d of interconnecting member 4 and a corresponding dimension D of connector 11, so as to create pressure and thus friction between opposite surfaces of interconnecting member 4 and connector 11 to maintain the connection between interconnecting member 4 and connector 11.

The razor handle 2 may further comprise a fork-shaped ejector as release mechanism 18 to facilitate release of the exchangeable razor blade cartridge 3 from the razor handle 2. The fork-shaped ejector may comprise two front prongs 18*a* extending from and spaced by a central block 18*b*. The fork-shaped ejector and spring-loaded pusher 9 may be received within the connector 11. The connector 11 may be open at a front portion 11*a* and a back portion 11*b* thereof. The spring-loaded pusher 9 may be positioned between the two front prongs 18*a* of the fork-shaped ejector, and a pusher spring 20 may be interposed between the spring-loaded pusher 9 and the central block 18*b* of the fork-shaped ejector.

According to further aspects, the interconnecting member 4 may comprise ears 21 adjacent to the protruding lips 15. Upon connection of the connector 11 with the interconnecting member 4, the two front prongs 18*a* of the fork-shaped ejector may be aligned with respective ears 21 of the interconnecting member 4 of the exchangeable razor blade cartridge 3.

A push button 23, forming a release trigger, may be arranged so as to emerge through an opening 27 at a middle segment 53 of the elongated body 13, midway between the front end 12 and rear end 14 thereof. The push button 23 may further be configured to move along transverse axis Z of the elongated body 13, plunging into the elongated body 13 when operated by a user to trigger the release of the exchangeable razor blade cartridge 3 from the razor handle 2. The elongated body 13 of the razor handle 2 may internally house a pushrod 22. The pushrod 22 may be glidingly supported in a sleeve 26 held within the elongated body 13, so as to mechanically connect the push button 23 to the release mechanism 18. Pushrod 22 may comprise a rounded end 22*a* configured to engage an inclined surface 23*a* of the push button 23. The inclined surface 23*a* may thus form a cam surface, and the rounded end 22*a* of pushrod 22 a cam follower, in a cam mechanism 56 configured to convert a plunging motion of push button 23 along a transverse axis Z intersecting longitudinal axis Y into a gliding motion of the pushrod 22 along longitudinal axis Y to actuate the release mechanism 18. Although in the illustrated example the cam surface is inclined and the cam follower rounded, they may be configured in alternative ways: for instance, the cam surface may be inclined and the cam follower rounded, or both may be inclined, or both may be rounded.

Figure 4:
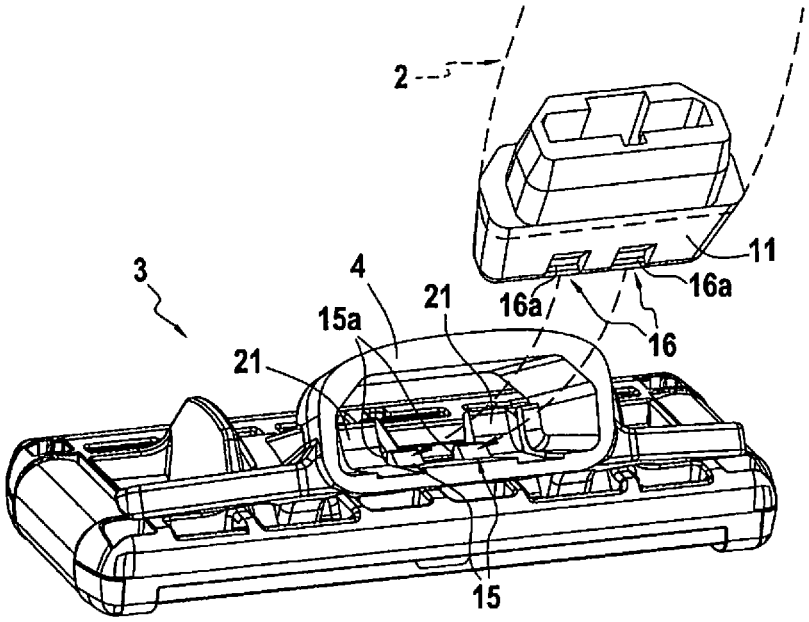
FIG. 4 illustrates how the razor handle and exchangeable razor blade may be connected.
Figure 5:
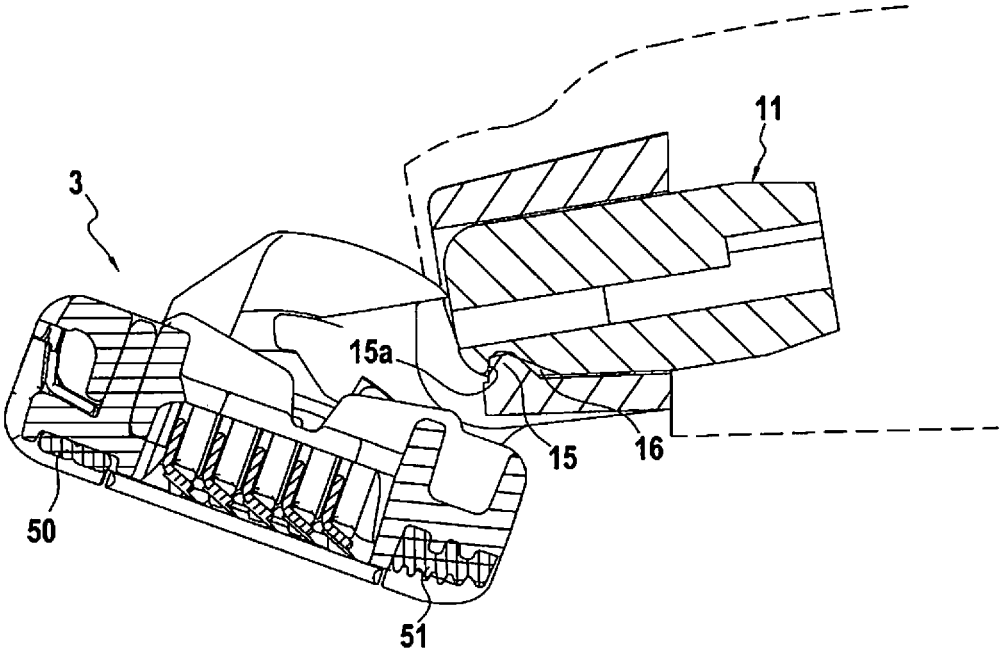
FIG. 5 is a detail cut view of the exchangeable razor blade cartridge and the connector of the blade handle once connected.
Figure 8A:
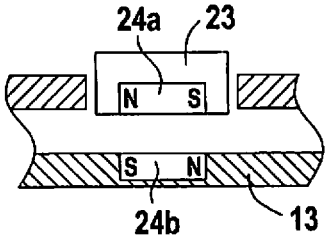
FIGS. 8A and 8B schematically illustrates alternative magnetic return mechanisms.
Figure 8B:
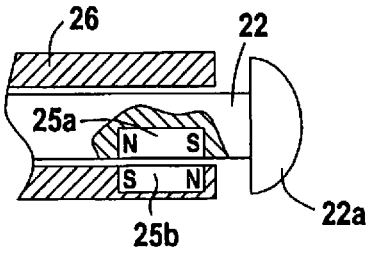

According to further aspects, both the pushrod 22 and the push button 23 may be spring-loaded. Spring-loading both the pushrod 22 and the push button 23 facilitates a return of pushrod 22 and push button 23 towards a starting position after the push button 23 has been pressed to release the exchangeable razor blade cartridge 3 from the razor handle 2. More specifically, the razor handle 2 may comprise a first return mechanism 24. The first return mechanism 24 may be for example, a single helical spring disposed at an end of the pushrod 22 opposite the rounded end 22*a*. The first return mechanism 24 may be configured to urge the pushrod 22 towards the rear end 14 of the razor handle 2 and against the inclined surface 23*a* of the push button 23. According to further aspects, the razor handle 2 may comprise a second return mechanism 25. The second return mechanism 25 may also be, for example, a single helical spring. The second return mechanism 25 may be configured to urge the push button 23 transversely outwards in a direction along the transverse axis Z. Corresponding abutting surfaces 17, 19 on, respectively, the push button 23 and elongated body 13 engage to thereby retain the push button 23 in a rest position against the first return mechanism 24 and second return mechanism 25, respectively. While single helical springs have been disclosed as the first and second return mechanisms 24, 25, aspects of the disclosure may not be limited to only helical springs. The first return mechanism 24 and second return mechanism 25 may be any similar mechanism capable of applying a force to thereby make an "urging" and/or "pushing" action and return to an initial state or position. Although the return force may be provided elastically, as illustrated in FIGS. 3 and 4, in further aspects it may be provided by alternative means, for instance magnetically, as illustrated in FIGS. 8A and 8B. As shown there, instead of a spring, first return mechanism 24 may comprise magnets 24*a* and 24*b* oriented so that same-sign poles face each other so as to repel each other and interposed between the push button 23 and the elongated body 13 to provide such a magnetic return force. Analogously, as illustrated on FIG. 8B, second return mechanism 25 may comprise, instead of a spring, magnets 25*a* and 25*b* oriented so as to provide another such magnetic return force.

Figure 9A:
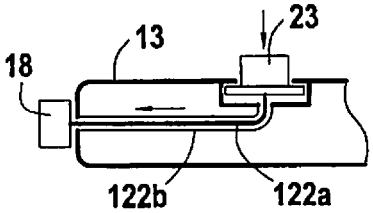
FIGS. 9A to 9D schematically illustrate alternative transmission mechanisms.
Figure 9B:
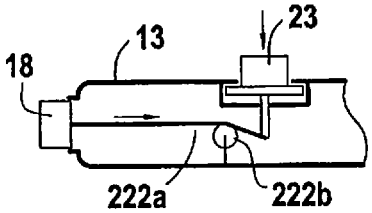
Figure 9C:
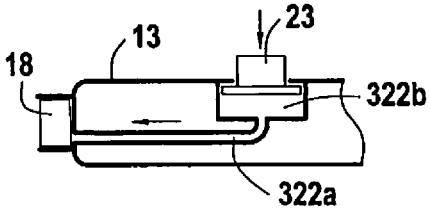
Figure 9D:
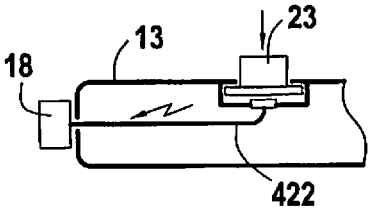

Although in FIGS. 3 and 4 the transmission mechanism is thus illustrated as formed by a cam mechanism 56 and a pushrod 22, alternatives to this specific form of transmission mechanism may be considered, such as, for instance, a cable, in particular a push and/or pull flexible member, such as a Bowden cable, a pneumatic or hydraulic transmission, an electric transmission, etc. As illustrated on FIG. 9A, the transmission mechanism may for instance comprise a flexible member 122*a*, such as a Bowden cable, arranged so as to glide within a closely-fitting guide sleeve 122*b* and connecting push to transmit a push from push button 23 to release mechanism 18. According to another aspect, as illustrated on FIG. 9B, the transmission mechanism may comprise a flexible member, such as a pull cable 222*a*, connecting push button 23 to the release mechanism 18 through a return pulley 222*b* for converting a push on push button 23 into a pull on pull cable 222*a* to actuate release mechanism 18 and trigger the release of the exchangeable razor blade cartridge 3 from the connector 11. According to yet another aspect, as illustrated on FIG. 9C, the transmission mechanism may comprise a hydraulic or pneumatic line 322*a* connecting a fluid chamber 322*b* to release mechanism 18, and the push button 23 may be configured as a piston or diaphragm delimiting fluid chamber 322*b*, so that pushing push button 23 may displace a fluid (gas or liquid) from fluid chamber 322*b* towards release mechanism 18 to actuate release mechanism 18 and trigger the release of the exchangeable razor blade cartridge 3 from the connector 11. According to a further aspect, as illustrated on FIG. 9D, the transmission mechanism may comprise an electric line 422 for transmitting an electric signal, which may be generated at push button 23 by, for instance, piezoelectric or electromagnetic means, to release mechanism 18 to actuate release mechanism 18 and trigger the release of the exchangeable razor blade cartridge 3 from the connector 11.

Further aspects may comprise that, apart from the razor blades 8 and springs, which are usually metallic, a majority of the parts of the razor 1 may be produced from organic polymeric material, in particular by injection molding techniques. Additional aspects may comprise co-injection techniques to produce parts with multiple colors and/or textures. For example, the razor handle 2 may include an elastomer for providing a good grip, co-injected on a more rigid thermoplastic polymer providing structural integrity. However, alternatively or complementarily to organic polymeric materials, other materials, such as for instance metal, glass or wood, and in particular moldable materials, may be used. Higher-density materials may for instance be used within the razor handle 2 in order to locate the center of gravity of the razor 1 at an ergonomically optimal location.

According to further aspects, operation of the exchangeable razor blade cartridge 3 may comprise connecting the exchangeable razor blade cartridge 3 to the razor handle 2 by inserting the connector 11 into interconnecting member 4 as shown in FIG. 4. The connector 11 may be inserted into the interconnecting member 4 until the protruding lips 15 of interconnecting member 4 snap into the undercuts 16 of the connector 11. Engagement of the latching surfaces 15*a* on the protruding lips 15 of the interconnecting member 4 against opposite surfaces 16*a* of the undercuts 16 of connector 11 may thus prevent axial separation of the connector 11 from interconnecting member 4 in the direction of longitudinal axis Y. According to further aspects, cooperating non-round cross-sectional shapes of the connector 11 and the interconnecting member 4 may also prevent relative rotation of the connector 11 and the interconnecting member 4 once joined by the snap-fit connection.

Figure 6A:
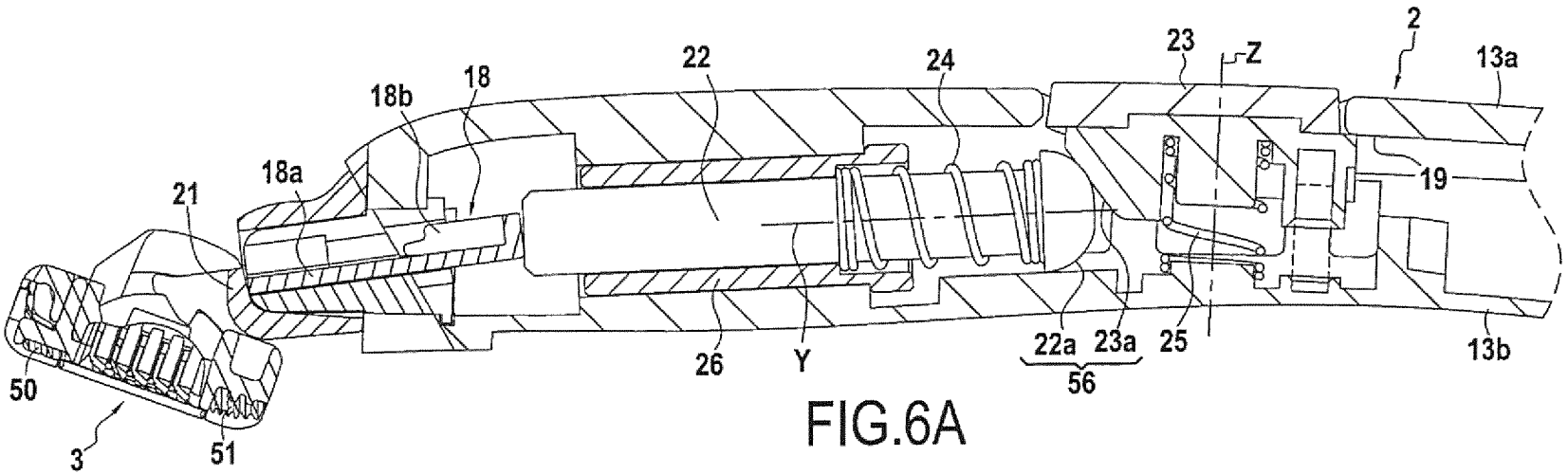
FIGS. 6A and 6B are detail views of the release mechanism of the razor respectively before and after release of the exchangeable razor blade cartridge from the razor handle.
Figure 6B:
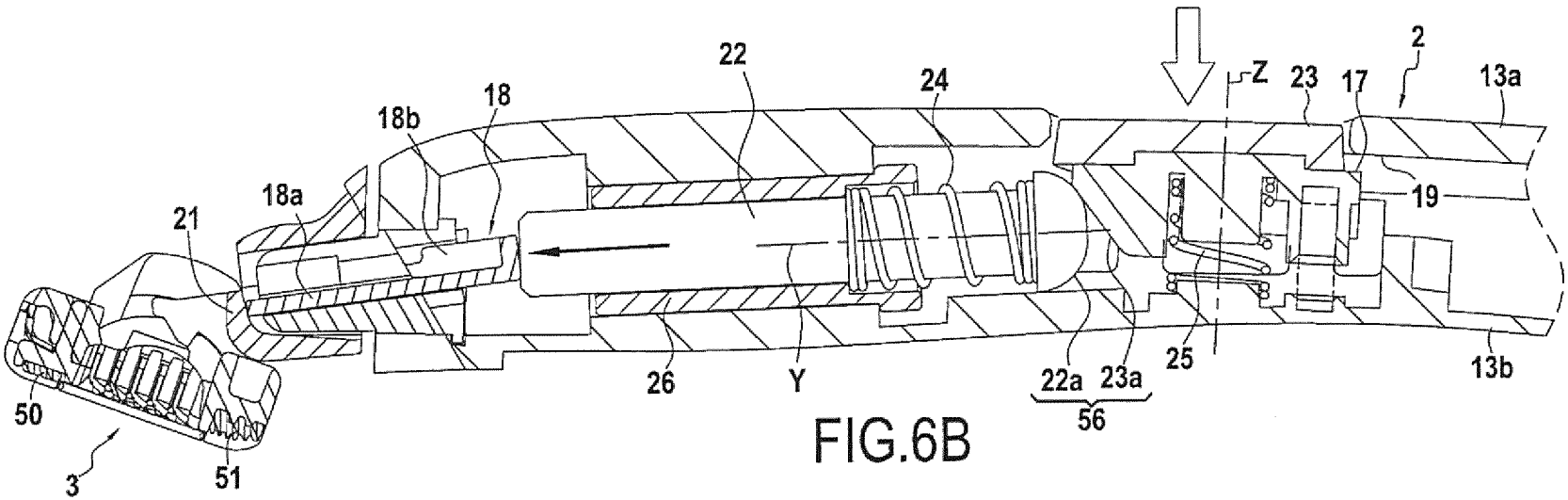

The push button 23, disposed at a middle segment 53 of the elongated body 13, may be engaged by the user, and pushed inwardly, to facilitate a release of exchangeable razor blade cartridge 3 from razor handle 2. Such engagement, plunging the push button 23 towards elongate body half shell 13*b*, along the transverse axis Z, and against second return mechanism 25, may be converted by the cam mechanism 56 into a forward gliding motion of pushrod 22 against the first return mechanism 24 and thereby pushing forward the release mechanism 18 through the cam mechanism 56 and the pushrod 22. As the inclined surface 23*a* of push button 23 glides against the rounded end 22*a* of pushrod 22, the cam mechanism 56 converts the plunging motion of push button 23 into a forward motion thereby pushing the pushrod 22 against first return mechanism 24. The release mechanism 18 then moves forward and front prongs 18*a* push against ears 21 of the interconnecting member 4, as shown on FIGS. 6A and 6B. According to further aspects, while the interconnecting member 4 may still be retained by the engagement of latching surfaces 15*a* on the protruding lips 15 of the interconnecting member 4 against opposite surfaces 16*a* of the undercuts 16 of connector 11, the force exerted by the front prongs 18*a* on ears 21 of the interconnecting member 4 may induce a bending stress in the interconnecting member 4. The bending stress may force the protruding lips 15 to deflect thereby causing the latching surfaces 15*a* to snap out of engagement with the opposite surfaces 16*a* of undercuts 16 in connector 11. When the latching surfaces 15*a* come out of engagement, the interconnecting member 4 may be released from the connector 11. A further push of the front prongs 18*a* against ears 21 may separate the exchangeable razor blade cartridge 3 from razor handle 2, as shown on FIG. 6B.

Those skilled in the art will recognize that the present disclosure may be manifested in a variety of forms other than the specific aspects described and contemplated herein. Accordingly, departure in form and detail may be made without departing from the scope of the present disclosure as described in the appended claims.

The invention claimed is:

1. A method for releasing an exchangeable razor blade cartridge from a razor handle, wherein the razor handle includes a body extending in a longitudinal direction between a front and a rear end, a connector for connecting an exchangeable razor blade cartridge to the razor handle, a release mechanism for releasing the exchangeable razor blade cartridge from the razor handle, a release trigger being offset longitudinally from the connector and being located in a middle segment of the body between the front and rear ends, the release trigger being movable in a direction transverse to the body, and a transmission mechanism connecting the release trigger to the release mechanism, the transmission mechanism being configured to convert a motion of the release trigger in the direction transverse to the body into a motion in the longitudinal direction of the body, wherein the transmission mechanism includes a push rod, the method comprising the steps of:

actuating the release trigger by moving the release trigger in the direction transverse to the longitudinal direction of the body;

transmitting a motion from the release trigger to actuate the release mechanism; and converting a motion of the release trigger in the transverse direction into a motion in the longitudinal direction of the body to release the exchangeable razor blade cartridge from the razor handle.

2. The method of claim 1, wherein the transmission mechanism includes a cam mechanism.

3. The method of claim 2, wherein the cam mechanism includes the push rod, the push rod having a cam follower disposed at an end thereof, the cam follower being configured to engage with a cam surface connected to the release trigger.

4. The method of claim 3, wherein one of the cam surface and the cam follower includes an inclined surface and another one of the cam surface and the cam follower includes a rounded surface engaging the inclined surface.

5. The method of claim 3, wherein the release mechanism is configured to deflect in response to the motion of the release trigger in the direction transverse to the body.

6. The method of claim 5, wherein the razor handle further includes a spring-loaded pusher disposed at the front end of the body.

7. The method of claim 6, wherein the release mechanism is a fork-shaped ejector including two front prongs, and the spring-loaded pusher is located between the two front prongs.

8. A razor handle comprising:

a body extending in a longitudinal direction between a front and a rear end;

a connector for connecting an exchangeable razor blade cartridge to the razor handle;

a release mechanism for releasing the exchangeable razor blade cartridge from the razor handle;

a release trigger being offset longitudinally from the connector and being located in a middle segment of the body between the front and rear ends, the release trigger being movable in a direction transverse to the body; and a transmission mechanism connecting the release trigger to the release mechanism, the transmission mechanism being configured to convert a motion of the release trigger in the direction transverse to the body into a motion in the longitudinal direction of the body, wherein the transmission mechanism includes a push rod.

9. The razor handle according to claim 8, wherein the transmission mechanism is spring-loaded.

10. The razor handle according to claim 9, wherein the release trigger is spring-loaded.

11. The razor handle according to claim 8, wherein the release trigger is a push button.

12. The razor handle according to claim 8, wherein the transmission mechanism includes a cam mechanism.

13. The razor handle according to claim 12, wherein the cam mechanism includes the push rod, the push rod having a cam follower disposed at an end thereof, the cam follower being configured to engage with a cam surface connected to the release trigger.

14. The razor handle according to claim 13, wherein one of the cam surface and the cam follower includes an inclined surface and another one of the cam surface and the cam follower includes a rounded surface engaging the inclined surface.

15. The razor handle according to claim 13, wherein the release mechanism is configured to deflect in response to the motion of the release trigger in the direction transverse to the body.

16. The razor handle according to claim 15, further including a spring-loaded pusher disposed at the front end of the body.

17. The razor handle according to claim 16, wherein the release mechanism is a fork-shaped ejector including two front prongs, and the spring-loaded pusher is located between the two front prongs.

18. A razor comprising:

a razor handle including:

a body extending in a longitudinal direction between a front and a rear end;

a connector for connecting an exchangeable razor blade cartridge to the razor handle;

a release mechanism for releasing the exchangeable razor blade cartridge from the razor handle;

a release trigger being offset longitudinally from the connector and being located in a middle segment of the body between the front and rear ends, the release trigger being movable in a direction transverse to the body; and a transmission mechanism connecting the release trigger to the release mechanism, the transmission mechanism being configured to convert a motion of the release trigger in the direction transverse to the body into a motion in the longitudinal direction of the body, and an exchangeable razor blade cartridge connected by the connector of the razor blade handle.

19. The razor according to claim 18, wherein the exchangeable razor blade cartridge includes a head, at least one razor blade and an interconnecting member for engaging the connector of the razor blade handle, the head being pivotable about an axis parallel with respect to the at least one razor blade.

20. The razor according to claim 18, wherein the exchangeable razor blade cartridge is snap-fitted to the connector of the razor blade handle.

* * * * *